US005529602A

United States Patent [19]

Ishii et al.

[11] Patent Number: 5,529,602

[45] Date of Patent: Jun. 25, 1996

[54] SINTERED IRON ALLOY RESISTANT TO ABRASION AT HIGH TEMPERATURE AND METHOD OF MANUFACTURING THE SAME

[75] Inventors: Kei Ishii; Yoshimasa Aoki; Hideaki Kawata, all of Chiba-ken; Akira Fujiki, Kanagawa-ken; Katsuyuki Nakamura, Kanagawa-ken; Kazuhiko Takahashi, Kanagawa-ken, all of Japan

[73] Assignees: Hitachi Powdered Metals Co., Ltd., Chiba-Ken, Japan; Nissan Motor Co., Ltd., Kanagawa-Ken, Japan

[21] Appl. No.: 392,183

[22] Filed: Feb. 22, 1995

[30] Foreign Application Priority Data

Feb. 23, 1994 [JP] Japan ..... 6-025132

[51] Int. Cl.[6] ..... C22C 29/00

[52] U.S. Cl. ..... 75/231; 428/550; 75/243; 75/245; 75/246

[58] Field of Search ..... 428/550; 75/243, 75/245, 246, 231; 420/84, 99, 100, 101, 102, 104, 105, 107, 108

[56] References Cited

U.S. PATENT DOCUMENTS

| | | | |
|---|---|---|---|
| 4,734,968 | 5/1988 | Kuroishi et al. | 29/156.7 |
| 4,919,719 | 4/1990 | Abe et al. | 75/243 |
| 5,080,713 | 1/1992 | Ishibashi et al. | 75/246 |

FOREIGN PATENT DOCUMENTS

| | | |
|---|---|---|
| 5-55593 | 8/1993 | Japan . |
| 5287463 | 11/1993 | Japan . |
| 5-80521 | 11/1993 | Japan . |

OTHER PUBLICATIONS

English abstract of Japanese Patent No. 5–55593.
English abstract of Japanese Patent No. 5–287463.
English abstract of Japanese Patent No. 5–80521.

*Primary Examiner*—Donald P. Walsh
*Assistant Examiner*—John N. Greaves
*Attorney, Agent, or Firm*—Greenblum & Bernstein

[57] ABSTRACT

Disclosed is a sintered iron alloy and a method of manufacturing the same. The sintered alloy comprises: an alloy matrix and a lead phase for imparting lubricability to the sintered alloy. The alloy matrix comprises a first alloy phase being composed of 0.5 to 3% nickel by weight, 0.5 to 3% molybdenum by weight, 5.5 to 7.5% cobalt by weight, 0.6 to 1.2% carbon by weight, and the balance iron, and a second alloy phase being composed of 26 to 30% molybdenum by weight, 7 to 9% chromium by weight, 1.5 to 2.5% silicon by weight, and the balance cobalt. The content of the lead phase in the sintered alloy is not more than 3.5% by weight. The lead phase is dispersed in the alloy matrix and a pore which is formed in the alloy matrix. The ratio of the lead dispersed in the alloy matrix to the total lead phase is 60% by weight or more, and the lead phase dispersed in the alloy matrix is particles in which the maximum particle size is 10 μm or less. In manufacture, a lead powder having a particle size of approximately 50 μm or less is mixed a first raw material powder for the first alloy phase and a second raw material powder for the second alloy phase at a lead content of not more than 3.5% by weight. After compacting and sintering the mixture, the sintered compact is cooled so that the temperature of the compact in the vicinity of 328° C. is cooled at a cooling rate of approximately 2° C./min. or more.

11 Claims, 5 Drawing Sheets

SINTERED IRON ALLOY RESISTANT TO ABRASION AT HIGH TEMPERATURE AND METHOD OF MANUFACTURING THE SAME

BACKGROUND OF THE INVENTION

1. Field of the Invention

The present invention relates to a sintered alloy and a manufacturing method thereof, and more particularly to a sintered iron alloy composition having excellent heat resistance, self-lubrication ability and abrasion resistance at high temperatures without sacrificing machinability, preferably to be used in manufacturing slide members such as valve seats for valve operating systems of internal combustion engines and the like, such that application of the slide members is not limited to only those for use with lead-free gasoline but also for use with leaded gasoline.

2. Description of the Prior Art

In a few countries such as Japan, the U.S.A. and some European countries, lead-free gasoline is mainly used as a fuel for internal combustion engines in automobiles and other transportation means. In contrast, in most other countries, for example, in the area of the Middle East, leaded gasoline is still now being widely used. As a result, if an internal combustion engine maker intends to supply his engine to a certain area of the engine market, it is necessary for him to know the actual conditions under which the engine will be used in that area. He then has to select or change the materials for the engine parts in accordance with the kind of gasoline which is supplied to the engine used in that market so that the engine has satisfactory durability. In particular for slide members such as valves and valve seats for valve operating systems and the like, this requirement is very important.

Moreover, in recent years, internal combustion engines have been remarkably developed so as to exhibit high performance. In accordance with this, sufficient durability must be imparted to the engine parts so as to bear harder and severer driving conditions. Especially, when leaded gasoline is supplied to the engine, it is highly necessary for slide members such as valve seats to have higher strength and abrasion resistance so that they can endure quite high temperatures.

Under the above-described circumstances, the inventors of the present patent application have conducted research on the respective parts of the valve operating system for internal combustion engines, and they have suggested a few materials for the valve seats in Japanese Patent Publication No. H5-55593 and Japanese Laid-Open Patent No.(Kokai) H5-287463.

The former document, Japanese Patent Publication No. H5-55593, discloses a sintered alloy composition which has excellent heat resistance. This sintered alloy is composed of a matrix phase which contains 0.5 to 3% nickel, 0.3 to 3 % molybdenum, 5.5 to 7.5 % cobalt, 0.6 to 1.2% carbon, and the balance iron, and a hard inter-metallic compound phase which contains 26 to 30% molybdenum, 7 to 9% chromium, 1.5 to 2.5% silicon, and the balance cobalt. The intermetallic compond phase is dispersed at a ratio of 5 to 25% in the matrix phase for improving abrasion resistance. This document also suggests a modified material for the above sintered alloy which is additionally infiltrated with a lead component which works as a solid lubricant.

The former alloy composition of the above document has been suggested as a material to be employed in an internal combustion engine which is used at an extremely high temperature or which is run on leaded gasoline, while the latter lead-infiltrated alloy material is for an internal combustion engine driven at a relatively low temperature or used with lead-free gasoline (mainly for Japanese use, accordingly).

In the early stages, the above lead-infiltrated alloy had been mainly employed, first, because a material having prominent machinability like the second-described alloy is convenient and preferable for manufacture of internal combustion engines, and second, because the thermal condition of the conventional internal combustion engine was not very high at that time, and the abrasion resistance of the lead-infiltrated alloy was therefore satisfactory for the engines using leaded gasoline.

However, the materials described in the former document soon became insufficient.

In detail, due to the lean-burn system which has been introduced into internal combustion engines for the purpose of achieving high-power output and clean exhaust gas and improving fuel consumption at the same time, the combustion temperature of the internal combustion engine has been raised. As a result, the valve seat in the valve operating system is heated to a temperature higher than the melting point of lead. Accordingly, it is impossible for the lead component to work as a solid lubricant, though lubrication is conventionally the main purpose of lead infiltration. As a result, the abrasion resistance and endurance reliability against high temperatures in a corrosive environment of the lead-infiltrated alloy material must be further improved. Moreover, when a high-performance internal combustion engine is operated at a high temperature using leaded gasoline, various substances, e.g., lead oxide which originates from the leaded gasoline, a scavenger agent contained in the leaded gasoline for promoting effective discharge of the lead component with the exhaust gas, and lead compounds such as lead sulfate, lead bromide, lead chloride and the like adhere to the valve and valve seat, causing corrosion. As a result, durability of these slide members tends to deteriorate badly due to corrosive wear. Especially, if the lead component is introduced by the infiltration method into the alloy material for the slide members, the phenomena of cracking and abrasion are more frequently observed in that alloy material. In short, althrough the lead-infiltrated alloy material has good machinability, peeling and abrasion of the base phase thereof is easily caused in a corrosive environment from use of gasoline containing a large amount of lead.

In comparison with the lead-infiltrated alloy, the former alloy material with no lead has better abrasion resistance at high temperatures. However, the former alloy material itself is very hard, and its machinability is extremely poor. Therefore, from the point of view of manufacture and production of internal combustion engines, it is necessary to improve the machinability for use as a material for valve seats.

The latter document, Japanese Laid-Open Patent No.(Kokai) H5-287463, discloses improvement of the abrasion resistance of the latter lead-containing alloy material of the former document by increasing the strength of the alloy material. Specifically, in the latter document, the alloy matrix of the former document is employed as is, and the raw materials for the alloy base are premixed with 1 to 5% of a copper material, thereby the pores which are scattered like fiber in the alloy material are filled with copper. In this alloy material, the copper component works to generate a liquid phase, and the strength of the alloy material is increased, which also leads to successful improvement of the abrasion resistance.

Moreover, in the alloy material of the latter document, the lead component for solid lubrication is introduced by addition of a lead material at an amount of 2% or less without use of the infiltration treatment. This is first, because, when the alloy material is exposed to a high temperature at which lead melts, the lead component infiltrated into the pores of the alloy material by a general method does not effectively exhibit ability as a solid lubricant, and second, because a problem has been found in the infiltrated lead component in that the lead component infiltrated into the pores causes cracking of the alloy material.

The above improved alloy material is the most prominent in abrasion resistance and machinability of conventional materials.

However, in accordance with the continual development of internal combustion engines, those advantages of the improved alloy material described above are no longer sufficient for recent internal combustion engine. Especially, the abrasion resistance is such that it cannot endure high temperatures and use of the leaded gasoline in a severely corrosive environment due to cracking and abrasion. Moreover, the further requirement of a longer life span makes necessary further improvement in the material for slide members.

Moreover, if an internal combustion engine is manufactured using of the conventional alloy materials described above as raw materials, it is necessary to change the manufacturing process of the raw material in accordance with the market to which the manufactured engine is supplied, in order to match the manufactured engine with the fuel which is used in that market. Such changes make the production line complicated and the manufacturing cost is raised thereby. This is quite troublesome and economically disadvantageous. However, since automobiles now are international commodities sold widely all over the world, it is desired to produce all engines through a common manufacturing process. Therefore, the creation of a material for slide members which can adapt to any type of engine, irrespective of the kind of the fuel being used, is required.

SUMMARY OF THE INVENTION

It is, therefore, an object of the present invention to provide a sintered alloy material which can be preferably employed in manufacturing internal combustion engine parts that have heat resistance, self-lubrication capability and abrasion resistance which can withstand a corrosive environment of high temperature due to the high output power of the internal combustion engine, without sacrificing machinability.

Another object of the present invention is to provide a sintered alloy material which can be used for manufacturing a valve seat in a valve operating system for internal combustion engines and whose utility is not limited to only lead-free gasoline engines but can also be used in leaded gasoline engines.

In accordance with the present invention, there is provided a sintered alloy composition comprising: an alloy matrix comprising a first alloy phase being composed of approximately 0.5 to 3% nickel by weight, approximately 0.5 to 3% molybdenum by weight, approximately 5.5 to 7.5% cobalt by weight, approximately 0.6 to 1.2% carbon by weight, and the balance iron, and a second alloy phase being composed of approximately 26 to 30% molybdenum by weight, approximately 7 to 9% chromium by weight, approximately 1.5 to 2.5% silicon by weight, and the balance cobalt; and a lead phase contained in the sintered alloy at a content of approximately 3.5% by weight or less, one portion of the lead phase being dispersed in the alloy matrix and the other portion being dispersed in a pore which is formed in the alloy matrix, in which the ratio of said one portion of the lead phase relative to the total off said one portion and the other portion is approximately 60% by weight or more, and said one portion of the lead phase is dispersed in the form of particles in which the maximum particle size is approximately 10 μm or less.

Moreover, there is also provided a sintered alloy comprising: a first alloy phase being composed of approximately 0.5 to 3% nickel by weight, approximately 0.5 to 3% molybdenum by weight, approximately 5.5 to 7.5% cobalt by weight, approximately 0.6 to 1.2% carbon by weight, and the balance iron; a second alloy phase being dispersed in the first alloy phase and being composed of approximately 26 to 30% molybdenum by weight, approximately 7 to 9% chromium by weight, approximately 1.5 to 2.5% silicon by weight, and the balance cobalt; and an effective amount of a lead phase for imparting lubricability to the sintered alloy, the lead phase being dispersed in the sintered alloy in the form of fine particles such that 97% by weight or more of the particles have a particle size of 10 μm or less.

Moreover, there is provided a method for manufacturing a sintered alloy, comprising: a preparing step for preparing a lead powder having a particle size of approximately 60 μm or less; a mixing step for mixing the lead powder prepared at the preparing step with a first raw material powder containing approximately 0.5 to 3% nickel by weight, approximately 0.5 to 3% molybdenum by weight, approximately 5.5 to 7.5% cobalt by weight, approximately 0.6 to 1.2% carbon by weight and the balance iron, and a second raw material powder containing approximately 26 to 30% molybdenum by weight, approximately 7 to 9% chromium by weight, approximately 1.5 to 2.5% silicon by weight and the balance cobalt, to form a mixed powder so that the lead content in the mixed powder is not more than approximately 3.5% by weight; a compacting step for compressing the mixed powder into a compact; a sintering step for heating the compact to a temperature of approximately 1,160° to 1,220° C. to sinter the compact; and a cooling step for cooling the compact, after the sintering step, so that the temperature of the compact in the vicinity of 328° C. is cooled at a cooling rate of approximately 2° C./min. or more.

According to the above construction, deterioration of abrasion resistance of the sintered alloy material at high temperatures in a corrosive environment is prevented by controlling the particle size and distribution ratio of the lead component. Moreover, the control of the particle size is easily achieved by limiting the lead content. Therefore, the sintered alloy of the present invention possesses machinability, heat durability, self-lubrication ability and abrasion resistance. Accordingly, the sintered alloy can be suitably used as a material for slide members such as valves and valve seats in internal combustion engines, irrespective of the fuel which is used for driving the engine. Either lead-free gasoline or high-leaded gasoline can be used in the engine in which a slide member made of the sintered alloy of the present invention is incorporated, even in a recent high-power internal combustion engine.

The features and advantages of the sintered alloy material according to the present invention will be more clearly understood from the following description of the preferred embodiments of the present invention taken in conjunction with the accompanying drawings.

DETAILED DESCRIPTION OF THE PREFERRED EMBODIMENTS

Figure 1A:
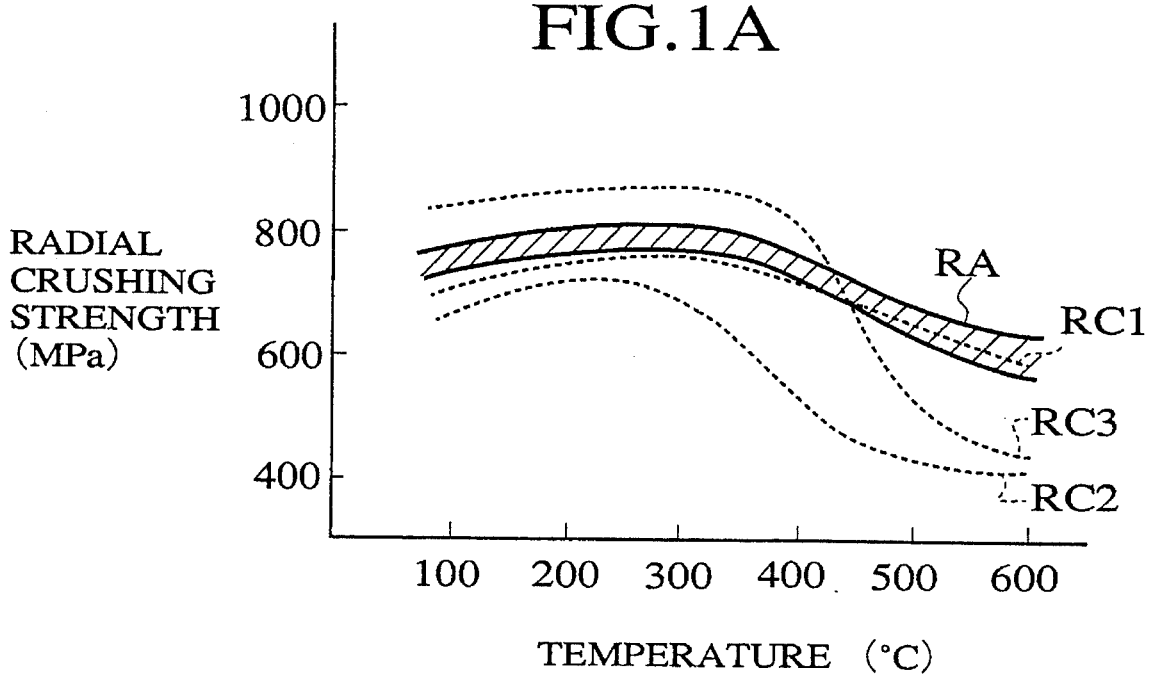
FIGS. 1A and 1B are graphs showing the relationship between the temperature and the radial crushing strength of the valve seats made of various sintered alloy materials.

Conventional lead-containing alloy materials are easily cracked and abraded when used at a high temperature or in a corrosive environment, and this damage seems to be caused by the lead component. However, the lead component imparts machinability to the alloy material, and machinability is an indispensable property for the alloy material which is formed into machine parts, especially, slide members such as a valve seat. Therefore, the lead component is required in the sintered alloy material to prevent the alloy material from being cracked and abraded so that it can withstand quite a high temperature and a corrosive environment.

Then the inventors of the present application have searched for the mechanism which causes the cracking and abrasion of the alloy material. As a result, it was found that the cracking and abrasion originate from corrosion of the alloy material and expansion of the lead component.

Specifically, the lead component in the pores causes corrosion to develop in the alloy material and weakens the material. Then, if the material is heated to a high temperature, the lead component expands to burst the pores of the material, thereby the alloy material is cracked. Additionally, the expanded lead component presses into the alloy matrix of the material to give rise to abrasion accompanied with peeling of the valve seating surface. In particular, if a copper component is additionally introduced into the alloy material for the purpose of generating a liquid copper phase in the alloy material to fill the fibrous pores with the liquid copper for the purpose of increasing strength and abrasion resistance of the alloy material, the copper component prevents the added lead material from being finely dispersed in the alloy material, so that the lead component is formed into a coarse agglomerate having a dimension of 15 to 20 μm. This coarse lead agglomerate easier facilitates the cracking and abrasion of the alloy material at the boundaries of the alloy matrix surrounding the lead phase. Then, as the lead particles dispersed in the alloy material become larger, the alloy material tends to crack and abrade easier.

In other words, if the lead component is quite finely dispersed in the alloy material, the alloy matrix can withstand the expansion of the lead component. Then, it becomes possible to impart machinability to the alloy material by addition of the lead component, without facilitating easy cracking and causing a loss of abrasion resistance, even at a high temperature or in a corrosive environment. Namely, the sintered alloy material according to the present invention is characterized in that the lead component is finely dispersed in the alloy material. The details of the sintered alloy material according to the present invention will now be described.

The sintered alloy material according to the present invention has an alloy matrix and a lead phase which is finely dispersed in or surrounded by the alloy matrix. The alloy matrix comprises a base phase containing nickel, molybdenum, cobalt, carbon, and iron, and a hard phase containing molybdenum, cobalt, chromium, and silicon. The base phase is preferably composed of 0.5 to 3% nickel, 0.5 to 3% molybdenum, 5.5 to 7.5% cobalt, 0.6 to 1.2% carbon, and the balance iron, and the hard phase is preferably composed of 26 to 30% molybdenum, 7 to 9% chromium, 1.5 to 2.5% silicon, and the balance cobalt, by weight. The hard phase is dispersed in the alloy material in an amount of 5 to 25% by weight. The lead phase is dispersed in the alloy material preferably in an amount of 0.1 to 3.5% by weight. Accordingly, the composition ratio of the alloy material as a whole is preferably 0.4 to 2.8% nickel, 1.6 to 10.3% molybdenum, 7 to 23% cobalt, 0.5 to 1.1% carbon, 0.4 to 2.2% chromium, 0.1 to 0.6% silicon, 0.1 to 3.5% lead, and the balance iron, by weight. The alloy material of the present invention may also contain a small amount of inevitable impurities. The above composition of the sintered alloy material is based on research in which promising results were found for an alloy containing the above-described components in the proper proportions.

Now, the properties and roles of the components of the sintered iron alloy according to the present invention will be described.

(1) Base Phase with Nickel, Molybdenum, Cobalt and Carbon

In the iron alloy base phase, both the nickel and the molybdenum work mainly to enhance the strength of the alloy material. This effect of these components has a relationship with the amounts of the respective components, and if the content is less than 0.5% by weight of either component, the sintered alloy product will not have sufficient strength. However, if the content exceeds 3% by weight, the effect is very little enhanced. Moreover, an excessive amount of molybdenum causes deterioration of the oxidation resistance of the obtained sintered alloy product. Therefore, the preferred content of each of the nickel and the molybdenum in the base phase is about 0.5 to 3% by weight, respectively.

The cobalt component effectively works to improve the abrasion resistance. However, if the cobalt content in the base phase is less than 5.5% by weight, the obtained alloy material lacks hardness at high temperatures and is easily abraded. On the other hand, if the cobalt content exceeds 7.5% by weight, the raw material powder containing the cobalt component becomes so hard that compressibility during the process of compacting the raw material powder deteriorates excessively. Therefore, the preferred cobalt content of the base phase is 5.5 to 7.5% by weight.

The carbon component forms carbide alloys with iron, chromium, and molybdenum to impart abrasion resistance to the sintered alloy product. In consideration of easy management of the sintering process and consistency of the sintered alloy product, the suitable carbon content of the base phase is 0.6 to 1.2% by weight.

As a raw material for the above-described nickel, molybdenum, and cobalt, excepting the carbon component, it is desired to use an alloy powder in which nickel, molybdenum, and cobalt are completely alloyed, in order to prevent segregation of those components, fully interdiffuse the base phase and the hard phase, and retain good compressibility of the raw material powder at the compacting step.

(2) Hard Phase with Molybdenum, Chromium and Silicon

A cobalt-based heat-resistant alloy is particularly suitable for the hard phase, an alloy being substantially composed of 26 to 30% molybdenum, 7 to 9% chromium, 1.5 to 2.5% silicon, and the balance cobalt.

The above-described hard phase effectively works to enhance the abrasion resistance of the sintered alloy product. This effect becomes satisfactory at a hard phase ratio of 5% by weight or more relative to the total amount. However, if the ratio of the hard phase exceeds 25% by weight, the strength of the sintered alloy product is reduced. Therfore, in light of abrasion resistance and strength, a preferred hard phase ratio is 5 to 25% by weight.

(3) Lead Phase

In connection with the characteristics of the valve seats formed by the sintered alloy material, the lead component works as a solid luburicant for reducing friction and also exhibits a great effect in improving machinability of the sintered alloy product. The lead component is introduced into the sintered alloy product by the steps of mixing a lead powder with raw material powders for the alloy matrix, i.e. the base phase and the hard phase, and compacting and sintering the powder mixture. Since the lead component has no solubility allowing it to form a solid solution with either the base phase alloy or the hard phase alloy, it precipitates as a simple lead phase in the sintered alloy product. The lead phase is produced in the form of a great number of particles dispersed in the alloy matrix or disposed in the pores which are formed between those alloy phases of the alloy matrix in the metallographic structure of the alloy product.

At the sintering step of the manufacturing process of the sintered alloy material according to the present invention, the compacted powder mixture is sintered at a temperature of about 1,190° C., which is considerably higher than the melting temperature of lead (=328° C.). Therefore, while the temperature is raised to the sintering temperature, the particles of the lead powder first become molten in the compacted powder mixture, and the molten lead component runs into the small spaces between the particles of the powders for the alloy matrix so that it is extended in all directions. In particular, at a temperature of about 750° C. or more, the ability of the molten lead component to wet the base alloy phase is drastically raised, and the lead component seems to be easily and widely extended. Then, as the temperature reaches the objective sintering temperature, sintering or connection by fusion of the powder particles proceeds between the powders for the base phase and the hard phase to form the base phase and the hard phase, while the extended liquid lead is shut into those spaces and finely separated by the sintered base phase and the hard phase. After the sintering treatment, the sintered alloy compact is cooled and the lead component is solidified to form the lead phase in the form of fine particles dispersed in the base phase and the hard phase or those disposed in the pores between these alloy phases.

As briefly described above, the essence of the present invention resides in fine dispersion of the lead component. If the lead particle has a particle size of 10 μm or less, the alloy matrix of the sintered alloy product can withstand expansion of the lead component, and the abrasion resistance of the obtained sintered alloy product is prevented from deteriorating at high temperatures due to addition of the lead component. Namely, the feature of the present invention resides in the fact that the lead component is finely dispersed in the sintered alloy material so as to reduce the proportion of the lead particles having a particle size exceeding 10 μm, suitably to 3% or less.

The particle size of the lead particles which are dispersed in the alloy matrix, changes in accordance with the particle size of the raw material powder for the lead phase, as understood from the above-described mechanism for forming the dispersed lead particles through the sintering step. Accordingly, the particle size of the dispersed lead phase can be appropriately controlled by limiting the particle size of the raw lead powder. If lead powder having a particle size (in sedimentation analysis) of 50 μm or less is used, a lead particle having a particle size of 10 μm or less can be suitably formed in the alloy matrix of the sintered alloy product. In a case of using a raw lead powder with a particle size exceeding 50 μm, a particle of the raw lead powder in the compacted powder mixture occupies such a large volume that a portion of the molten lead may not be divided into sufficiently fine portions.

As described above, the melted and finely dispersed lead component is shut between the alloy phases during the sintering treatment. However, if the compacted powder mixture is cooled gradually after the sintering treatment, the separated and dispersed lead portions re-connect and grow, in particular, at a temperature in the vicinity of the melting point of lead. Therefore, it is preferred to cool the sintered alloy compact at a rate of about 2° C./min. or more, at least when the temperature of the sintered alloy compact is passing the vicinity of 328° C.

Moreover, if the cooling rate is lower than the above-described value, the liquid lead portion in the alloy phase tends to move out of the alloy phase into the pores during the cooling treatment, and the ratio of the lead particles being distributed in the alloy phase falls. This movement of the liquid lead portion causes unification of a plurality of the liquid lead portions in a pore to form a larger lead particle. Therefore, it is necessary to cool the sintered alloy compact quickly so as to not reduce the ratio of the lead component distributed in the alloy phase. In this regard, with use of a general metallurgical method for preparation of the powder mixture compact, if the sintered compact is cooled at the preferred cooling rate described above, the lead distribution ratio in the alloy phase is maintained at a value of 60% by weight or more and there are few large lead particles in the pores. However, if the sintered compact is cooled slowly, the ratio of the lead particles distributed in the alloy matrix is reduced to less than 60% by weight due to the slow cooling. As a result, the amount of undesirable large lead particles is raised remarkably at the pore side, thereby the abrasion resistance of the sintered alloy product at high temperatures deteriorates excessively. Therefore, regulation of the distribution ratio of the lead component is important for reducing the size of the lead particles distributed in the pores of the sintered alloy material. If the distribution ratio of the lead component in the alloy phases is remarkably reduced, the sintered alloy material becomes similar to the conventional lead-infiltrated alloy material so that peeling and abrasion are caused by expansion of the lead component at a high temperature in a corrosive environment.

Usually, the shape of the pore in the sintered alloy material is rather complicated, and the lead particle in the pore is also irregular, so that it is rather difficult to measure the dimension of the lead particle in the pore. However, the distribution ratio of the lead particle has a great effect on the dimension of the lead particle in the pore, as described above. Therefore, the feature of the sintered alloy material according to the present invention, that is, reduction of the ratio of large lead particles in the sintered alloy material can be specifically viewed as combination of limiting the maximum particle size of the lead component in the alloy phases and regulating the lead component distributed in the pores. Consequently, this feature of the invention can be regarded as being substantially equal to a combination of a structural feature of the sintered alloy material, whereby the maximum particle size of the lead component distributed in the alloy phases is 10 μm or less, and a compositional feature whereby the ratio of the lead component distributed in the alloy phase is 60% by weight or more.

The lead component works as a solid lubricant and is added to improve the machinability of the sintered alloy product. The effective amount of the lead component for imparting sufficient machinability is 0.1% by weight or more. If the lead content of the sintered alloy product is less than 0.1% by weight, the machinability of the sintered alloy product is not distinctly improved, and the self-lubrication capability and abrasion resistance which are necessary for valve seats are not raised.

Moreover, it is preferred to limit the lead content so as not to exceed 3.5% by weight. The reason for this limitation is because it is rather difficult with the lead content over 3.5% by weight to control the particle size of the lead phase in both the alloy matrix and the pores. In detail, if the lead content is raised, the proportion of the lead component in each of the alloy matrix and the pores is also raised, respectively. As a result, the probability of uniting the dispersed lead portions increases, and the lead particles in the sintered alloy product tend to grow. Then, if the lead content is extremely raised, the pores of the obtained alloy product are filled with an increased amount of the lead component similar to the conventional infiltrated alloy material.

In the above description, a common metallographic test can be used to determine whether a certain lead particle is in the alloy matrix or resides in a pore. In the metallographic structure of the section of the sintered alloy product which is determined by photomicrography, X-ray diffraction analysis or the like, if a lead particle is in contact with air, the lead particle is regarded as being disposed in a pore. On the contrary, a lead particle without coexistence of air is regarded as being dispersed in the alloy matrix. Accordingly, the above limitation in distribution whereby 60% by weight or more of the lead component is dispersed in the alloy matrix corresponds, in other words, to whereby 60% by weight or more of the lead component is not in contact with air in the photomicrograph of the sintered alloy product, statistically.

In general, a sintered alloy containing the alloy matrix but no lead component has about 7 to 15% by volume of pores, and a microphotograph in a section of this alloy shows that the dimension of the pores is about 2 to 150 μm. In contrast, if the sintered alloy containing the lead component according to the present invention is similarly observed by means of the microphotograph thereof, there is no portion which contains air and a lead particle contacting therewith and which has a dimension of 25 μm or less in the metallographic structure. From this observation, it is considered that the small pores are completely filled with the lead component during the manufacturing process. On this position, there may be some discrepancy in the above definition about the location of the lead component. However, the above-described definition is preferable to clearly determine the scope of the invention. Therefore, the above-described definition will be used for determining the present invention.

The sintered iron alloy product as described above is manufactured by using an ordinary sintering technique. Specifically, the manufacturing process comprises the steps of: preparing a lead powder having a suitable particle size as described above, as a raw material for the lead phase; mixing raw material powders for the components composing the sintered iron alloy so that the obtained mixed powder has a composition in which the content off each component is within the above-described preferable range; compressing the mixed powder obtained in the mixing step to form a compact for products such as machine parts; sintering the compact; and cooling the sintered compact at a suitable cooling rate as described above.

For the raw materials, an alloy powder containing the components for the base phase, an alloy powder for the hard phase and a lead powder having a particle size of 50 μm or less are prepared.

At the mixing step, the alloy powder for the base phase, the alloy powder for the hard phase, and the lead powder are preferably used as a raw material powder, as mentioned above. These powders are uniformly mixed with each other so that the lead powder is wholly dispersed.

The obtained mixed powder is then compressed to form a compact with a predetermined shape during the compacting step. The green density of the compact is set, preferably, so that the density ratio (green density / true density of the same composition) is within a range of 78 to 95.

The compact is then subjected to sintering. For the sintering, the temperature is raised to a sintering temperature within a range of 1,160° to 1,220° C., preferably in the vicinity of 1,190° C., and this temperature is maintained for about 30 minutes.

After the sintering, the sintered compact is cooled at a cooling rate of 2° C./min. or more, especially in the vicinity of 328° C. Preferably, the cooling rate is set within a range of 4° to 6° C./min.

The above-described sintered alloy product according to the present invention can be further improved by subjecting the alloy product to various aftertreatments. For example, if the improvement is for use as a part of an engine of a high-temperature and high-compression-ratio type such as a diesel engine, it is effective to repress the obtained alloy product to increase the density of the product. Alternatively, if it is to increase the stability of the structure of the alloy product, the alloy obtained after the sintering is subjected to quenching and tempering treatment for thermal refining of the structure.

EXAMPLES

Now, a few samples of the sintered alloy products of the present invention, adopting the most preferable amount of components for the alloy matrix, and some samples of the conventional materials will be described.

(Raw Materials)

For the base alloy phase, an atomized iron alloy powder composed of 1.5% nickel, 1.5% molybdenum, 6.5% cobalt, and the balance iron, by weight, and having a particle size of 144 μm or less was prepared as a main raw material.

For the hard alloy phase to be dispersed in the base alloy phase, an inter-metallic compound powder composed of 28% molybdenum, 8% chromium, 2% silicon, and the balance cobalt by weight was prepared.

Moreover, some stamp-milled lead powders each having a different particle size including a particle size of 50 μm and less were prepared as materials for the lead phase dispersed in the alloy matrix.

Additionally, a carbon powder for introduction of the carbon component, and an electrolytic copper powder having a particle size off 50 μm or less were prepared.

(Manufacture of Samples)

Referring to Table 1, the sintered alloy products of Sample Nos. A1 to A6, B1 to B9 and C1 to C3 were prepared by using the above-described raw materials, as follows. In Table 1, the DR value is a percentage by weight of the lead component dispersed in the alloy matrix of the sintered alloy product relative to the total amount of the lead component, and the value PS is the maximum particle size of the lead component dispersed in the alloy matrix of the sintered alloy product. The sintered alloy product of Sample Nos. C1 to C3 correspond to the conventional alloy materials disclosed in Japanese Patent Publication No. H5-55593 and Japanese Laid-Open Patent No.(Kokai) H5-287463, respectively.

Sample No. A1

The above-described raw material powders were appropriately blended, referring to the composition ratio of Sample No. A1 which is shown in Table 1, and they were further mixed with 0.8% by weight of a zinc stearate powder as a lubricant. The mixed powder was compressed to form a compact with a green density of 6.9 g/cm$^3$ and a predetermined shape for a valve seat. This compact was heated to 1190° C. and sintered at that temperature for 30 minutes in a dissociated ammonia atmospher. The sintered compact was cooled at a cooling rate of about 5° C./min to obtain the sintered alloy product of Sample No. A1.

Samples No. A2 to A6

In each case, the manufacturing process for Sample No. A1 was repeated, excepting that the lead powder was appropriately changed to another lead powder having a larger particle size within a range of 50 μm or less, and the blending ratio off the lead powder was changed with reference to Table 1, thereby each of the sintered alloy product of Sample Nos. A2 to A6 was obtained, respectively.

Samples No. B1 to B4

In each case, the manufacturing process for Sample No. A1 was repeated, excepting that the lead powder was appropriately changed to another lead powder having a larger particle size of less than 50 μm, the blending ratio of the lead powder was changed with reference to Table 1, and the cooling rate was reduced to a value of less than 2° C./min, thereby each of the sintered alloy product of Sample Nos. B1 to B4 was obtained, respectively.

Samples No. B5 to B9

In each case, the manufacturing process for Sample No. A1 was repeated, excepting that the lead powder was appropriately changed to another lead powder having a particle size larger than 50 μm, and the blending ratio of the head powder was changed with reference to Table 1, thereby each of the sintered alloy product of Sample Nos. B5 to B9 was obtained, respectively.

Sample No. C1

The manufacturing process for Sample No. A1 was repeated, excepting that the lead powder was not used to change the composition ratio with reference to Table 1, thereby the sintered alloy product of Sample No. C1 was obtained.

Sample No. C2

The manufacturing process for Sample No. C1 was repeated to obtain another piece of the sintered alloy product of Sample No. C1. This product was infiltrated with liquid lead component so that the composition ratio was regulated to 12.0% by weight, thereby the sintered alloy product of Sample No. C2 was obtained.

Sample No. C3

The manufacturing process for Sample No. A1 was repeated, excepting that electrolytic copper powder was used to change the composition ratio with reference to Table 1, thereby the sintered alloy product of Sample No. C3 was obtained.

(Measurement of Mechanical Properties)

The sintered alloy products of Sample Nos. A1 to A5, B1 to B9 and C1 to C3 were measured for radial crushing strength, abrasion loss, machinability, and actual abrasion loss in use as a valve seat of an actual engine as follow The results of the measurements are shown in Table 2.

The radial crushing strength was measured at temperatures of 100° C., 200° C., 300° C., 400° C., 500° C. and 600° C. by means of an Amsler type universal tester.

The abrasion loss was measured at temperatures of 200° C., 250° C., 300° C., 350° C., 400° C., 450° C. and 500° C. in accordance with a simplified abrasion test. Specifically a valve seat which was processed by using the sintered alloy manufactured above was pressed into a housing of a test machine which is made of aluminum alloy. Then, a valve on which stellite alloy was provided was set to the test machine so that the valve can be reciprocally moved to the valve seat by rotation of an eccentric cam which is rotated by a motor at a speed of 2,600 rpm. The position of the valve, at which the valve abuts on the valve seat, was measured. Then, the valve was reciprocated for 30 hours so that the valve face repeatedly struck the valve seat. During the reciprocal motion of the valve, the valve head was heated at either of the measuring temperatures by using a burner. After the above reciprocal operation, the position of the valve was measured again, and the differential distance between the positions of the valve before and after the reciprocal operation was calculated for estimation of the abrasion loss.

The machinability was measured by using a lathe. First, the valve seat was set in an NC lathe, and the seat surface at the inner bore thereof was cut with a cutter which was made of a diamond chip and revolved at a speed of 500 rpm, while the feeding speed of the cutter was regulated to 0.12 mm/rev. The above cutting operation was repeated for 1,500 valve seats. After the cutting operation, wear of the cutting edge of the cutter was measured for estimation of the machinability of the sintered alloy product.

The actual abrasion loss in use with an actual engine was measured by using a 2,000 cc DOHC type four-cylinder engine in which the cylinder head was made of an alluminum alloy. The sintered alloy product was machined and formed into an exhaust valve seat, and was pressed into the cylinder head of the engine. Then, a bench test for durability of the engine was performed by using a valve which was made of a refractory steel and provided with a stellite alloy. The bench test was continued for 200 hours by driving the engine at a full load of 6,400 rpm with use of high-leaded gasoline as a fuel. Before and after the bench test, the position of the valve, at which the valve abuts the valve seat, was measured and the differential distance between these positions was calculated for estimation of the actual abrasion loss.

TABLE 1

| | Composition (wt %) | | | | | | | | | | | | |
|---|---|---|---|---|---|---|---|---|---|---|---|---|---|
| | | Base phase | | | | | | Hard phase (15 wt %) | | | | DR value | PS value |
| No. | Pb | Ni | Mo | Co | C | Cu | Fe | Mo | Cr | Si | Co | (wt %) | (μm) |
| A1 | 0.07 | 1.5 | 1.5 | 6.5 | 0.8 | — | balance | 28 | 8 | 2 | balance | 71 | 2 |
| A2 | 0.11 | 1.5 | 1.5 | 6.5 | 0.8 | — | balance | 28 | 8 | 2 | balance | 68 | 3 |
| A3 | 0.20 | 1.5 | 1.5 | 6.5 | 0.8 | — | balance | 28 | 8 | 2 | balance | 64 | 3 |
| A4 | 1.05 | 1.5 | 1.5 | 6.5 | 0.8 | — | balance | 28 | 8 | 2 | balance | 65 | 5 |

TABLE 1-continued

| | Composition (wt %) | | | | | | | | | | | | |
|---|---|---|---|---|---|---|---|---|---|---|---|---|---|
| | | Base phase | | | | | | Hard phase (15 wt %) | | | | DR value | PS value |
| No. | Pb | Ni | Mo | Co | C | Cu | Fe | Mo | Cr | Si | Co | (wt %) | (μm) |
| A5 | 2.25 | 1.5 | 1.5 | 6.5 | 0.8 | — | balance | 28 | 8 | 2 | balance | 65 | 6 |
| A6 | 3.49 | 1.5 | 1.5 | 6.5 | 0.8 | — | balance | 28 | 8 | 2 | balance | 68 | 8 |
| B1 | 0.95 | 1.5 | 1.5 | 6.5 | 0.8 | — | balance | 28 | 8 | 2 | balance | 48 | 5 |
| B2 | 2.20 | 1.5 | 1.5 | 6.5 | 0.8 | — | balance | 28 | 8 | 2 | balance | 52 | 5 |
| B3 | 3.86 | 1.5 | 1.5 | 6.5 | 0.8 | — | balance | 28 | 8 | 2 | balance | 42 | 6 |
| B4 | 6.01 | 1.5 | 1.5 | 6.5 | 0.8 | — | balance | 28 | 8 | 2 | balance | 50 | 7 |
| B5 | 1.07 | 1.5 | 1.5 | 6.5 | 0.8 | — | balance | 28 | 8 | 2 | balance | 66 | 12 |
| B6 | 3.93 | 1.5 | 1.5 | 6.5 | 0.8 | — | balance | 28 | 8 | 2 | balance | 69 | 12 |
| B7 | 3.20 | 1.5 | 1.5 | 6.5 | 0.8 | — | balance | 28 | 8 | 2 | balance | 71 | 14 |
| B8 | 3.93 | 1.5 | 1.5 | 6.5 | 0.8 | — | balance | 28 | 8 | 2 | balance | 66 | 16 |
| B9 | 4.18 | 1.5 | 1.5 | 6.5 | 0.8 | — | balance | 28 | 8 | 2 | balance | 62 | 20 |
| C1 | — | 1.5 | 1.5 | 6.5 | 0.8 | — | balance | 28 | 8 | 2 | balance | — | — |
| C2 | 12.0 | 1.5 | 1.5 | 6.5 | 0.8 | — | balance | 28 | 8 | 2 | balance | — | — |
| C3 | 1.04 | 1.5 | 1.5 | 6.5 | 0.8 | 2.8 | balance | 28 | 8 | 2 | balance | 61 | 18 |

TABLE 2

| | Radial crushing strength (MPa) Temperature (°C.) | | | | | | Abrasion loss (μm) Temperature (°C.) | | | | | | | Wear of cutter | Actual abrasion loss |
|---|---|---|---|---|---|---|---|---|---|---|---|---|---|---|---|
| No. | 100 | 200 | 300 | 400 | 500 | 600 | 200 | 250 | 300 | 350 | 400 | 450 | 500 | (μm) | (μm) |
| A1 | 700 | 745 | 750 | 710 | 655 | 580 | 106 | 56 | 47 | 40 | 42 | 48 | 67 | 30 | 165 |
| A2 | 725 | 775 | 780 | 790 | 680 | 625 | 70 | 45 | 38 | 35 | 33 | 38 | 43 | 17 | 148 |
| A3 | 725 | 780 | 770 | 730 | 670 | 625 | 70 | 43 | 35 | 35 | 30 | 36 | 43 | 16 | 138 |
| A4 | 740 | 780 | 785 | 735 | 670 | 625 | 69 | 36 | 35 | 32 | 30 | 34 | 45 | 15 | 135 |
| A5 | 740 | 790 | 800 | 720 | 640 | 590 | 65 | 37 | 33 | 28 | 27 | 34 | 45 | 15 | 140 |
| A6 | 770 | 800 | 795 | 760 | 630 | 560 | 63 | 38 | 30 | 25 | 25 | 34 | 48 | 15 | 160 |
| B1 | 725 | 755 | 770 | 680 | 580 | 440 | 70 | 45 | 40 | 34 | 38 | 59 | 92 | 15 | 220 |
| B2 | 720 | 755 | 770 | 675 | 575 | 430 | 68 | 47 | 42 | 36 | 37 | 65 | 99 | 14 | 248 |
| B3 | 750 | 790 | 773 | 700 | 550 | 430 | 68 | 47 | 41 | 36 | 43 | 75 | 125 | 14 | 273 |
| B4 | 750 | 790 | 710 | 580 | 510 | 420 | 65 | 45 | 40 | 35 | 49 | 93 | 140 | 13 | 295 |
| B5 | 740 | 775 | 780 | 740 | 680 | 610 | 70 | 45 | 43 | 39 | 38 | 65 | 95 | 14 | 250 |
| B6 | 680 | 700 | 690 | 520 | 440 | 420 | 58 | 39 | 35 | 25 | 39 | 55 | 70 | 13 | 202 |
| B7 | 770 | 800 | 790 | 755 | 635 | 540 | 67 | 46 | 42 | 38 | 39 | 70 | 98 | 15 | 263 |
| B8 | 680 | 700 | 690 | 515 | 490 | 450 | 65 | 47 | 43 | 35 | 35 | 79 | 108 | 15 | 278 |
| B9 | 685 | 695 | 680 | 530 | 480 | 440 | 61 | 43 | 43 | 38 | 41 | 80 | 137 | 15 | 293 |
| C1 | 700 | 750 | 755 | 725 | 650 | 580 | 125 | 50 | 45 | 40 | 40 | 48 | 65 | 40 | 175 |
| C2 | 660 | 710 | 690 | 515 | 420 | 410 | 50 | 33 | 30 | 30 | 48 | 103 | 200 | 14 | 313 |
| C3 | 840 | 860 | 860 | 890 | 520 | 440 | 63 | 23 | 23 | 24 | 45 | 70 | 125 | 15 | 258 |

Figure 1B:
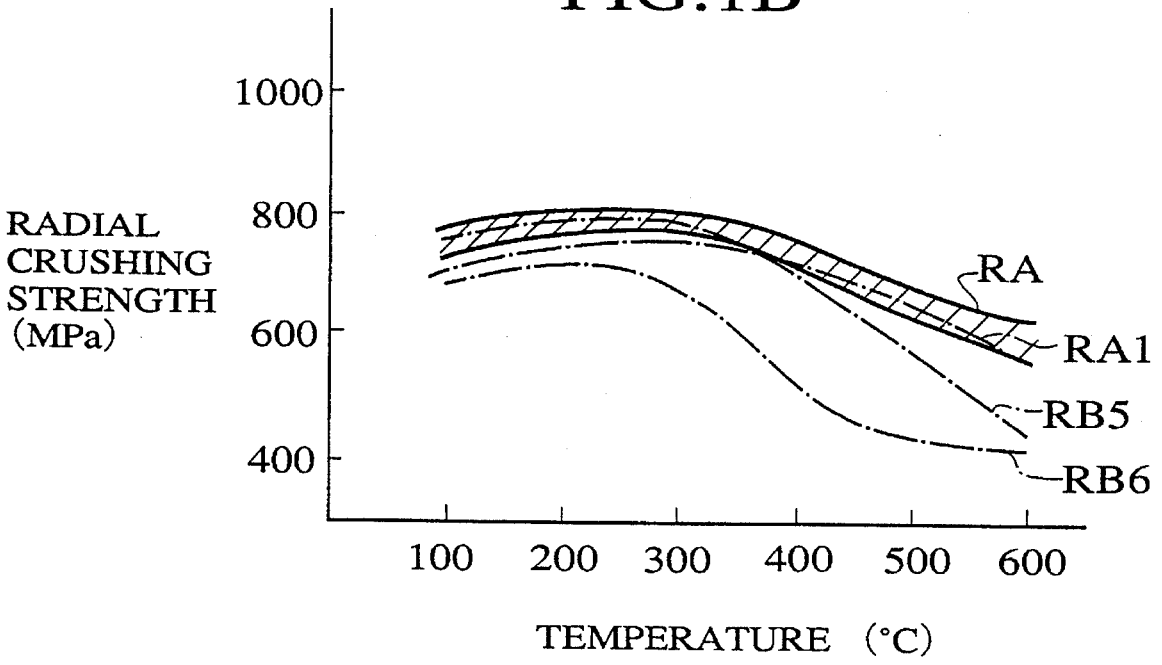

FIGS. 1A and 1B are graphs showing the relationship between the measuring temperature and the radial crushing strength of each of the sintered alloy products. In FIGS. 1A and 1B, the results of measurements of Samples No. A2 to A6 are illustrated by the zone RA, and those of Samples No. C1 to C3 are illustrated by broken lines RC1, RC2 and RC3, respectively. The chain lines A1, B5 and B6 shows the results of Samples No. A1, B5 and B6, respectively.

As shown in FIG. 1A, the radial crushing strength in each of the sintered alloys of Samples No. C2 and C3 deteriorates excessively at high temperatures above 400° C. due to large lead particles dispersed in the alloy matrix or the lead infiltrated into the alloy material. In contrast, in the sintered alloy of Sample No. C1, which contains no lead component, reduction of the radial crushing strength at high temperatures above 400° C. is rather moderate. Moreover, in FIG. 1B, the results of Samples No. A1 and B6 show that, the radial crushing strength falls at high temperatures, as the lead content of the sintered alloy increases. However, as understood from the result of Sample No. B5, deterioration of the radial crushing strength at high temperatures due to increase of the lead component can be effectively controlled by reducing the size of the lead particles dispersed in the alloy matrix.

Moreover, it is also understood from Tables 1 and 2 that if the percentage of the lead component dispersed in the alloy matrix of the sintered alloy product relative to the total amount of the lead component (Distribution Ratio: DR value) decreases, the radial crushing strength of the sintered alloy falls at high temperatures.

Figure 2A:
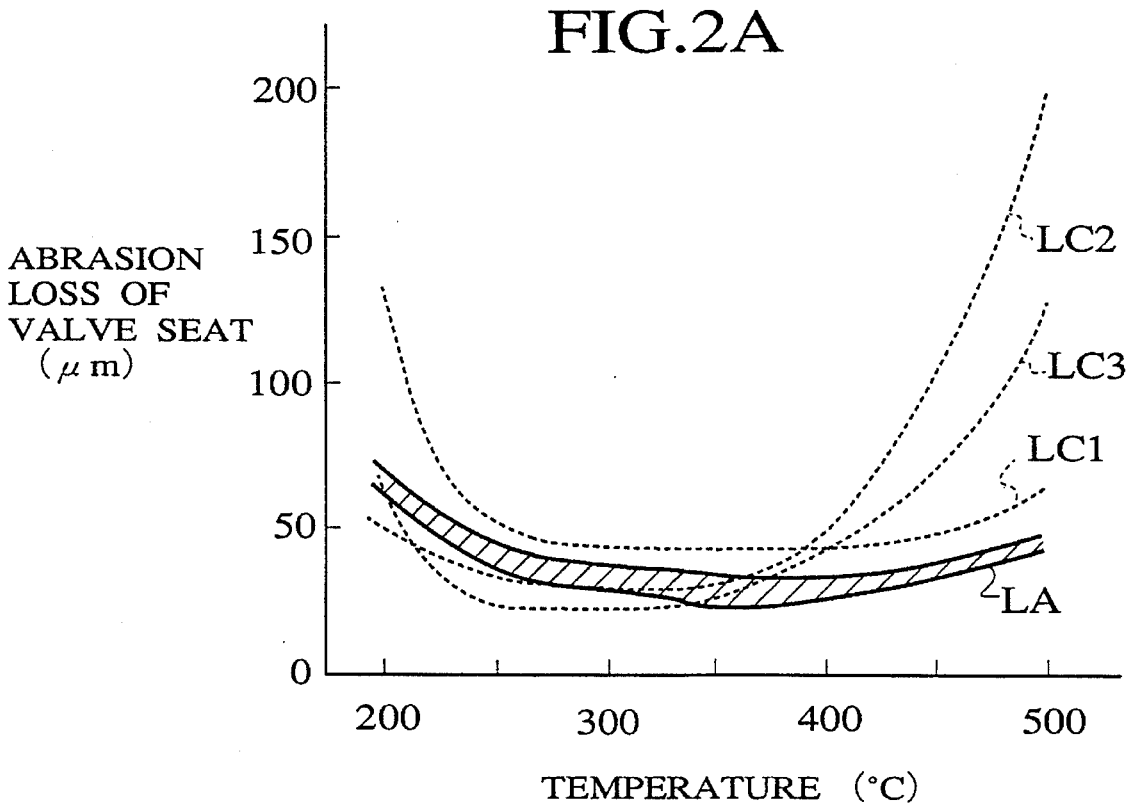
FIGS. 2A and 2B are graphs showing the relationship between the temperature and the abrasion loss of the valve seats made of various sintered alloy materials.
Figure 2B:
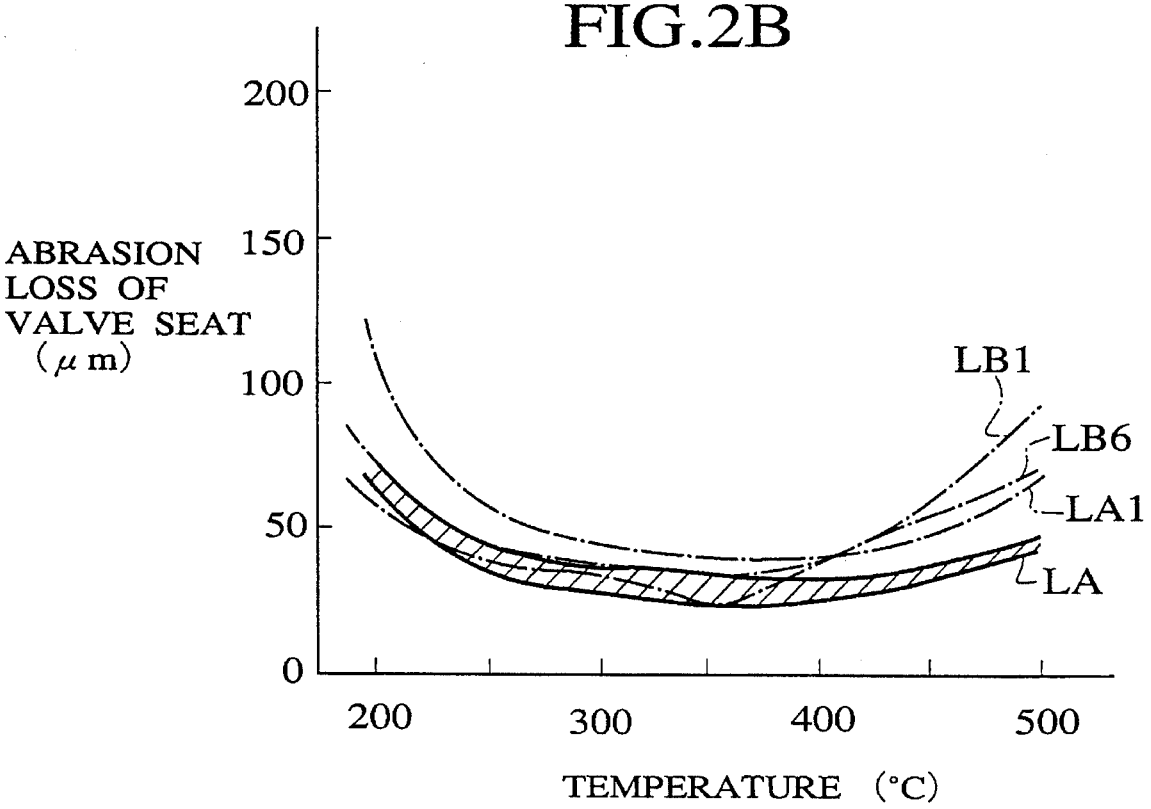

FIGS. 2A and 2B are graphs showing the relationship between the measuring temperature and the abrasion loss of each of the valve seats made of the sintered alloy product. In FIGS. 2A and 2B, the results of measurement in Samples No. A2 to A6 are illustrated by the zone LA, and those in Samples No. C1 to C3, A1, B1 and B6 are illustrated by broken lines LC1, LC2 and LC3 and the chain lines LA1, LB1 and LB6, respectively.

As shown in FIG. 2A, the abrasion loss in each of the sintered alloys of Samples No. C2 and C3 is remarkably raised at high temperatures above 400° C. due to large lead particles precipitated in the alloy matrix or the infiltrated lead component. In contrast, in the sintered alloy of Sample No. C1, which contains no lead component, the abrasion loss is scarcely raised at high temperatures. However, the abrasion loss of the Sample No. C1 tends to increase at temperatures below 250° C. Moreover, from FIG. 2B and Table 2, it is understood that the increase of abrasion loss at high temperatures can be checked by reducing the particle size of the lead component dispersed in the alloy matrix and maintaining the DR value (percentage of the lead component dispersed in the alloy matrix) at 60% or more. As shown in FIGS. 2A and 2B, the sintered alloy of Samples No. A2 to A6 retains excellent abrasion resistance throughout the temperature range of 200° C. to 500° C.

Figure 3:
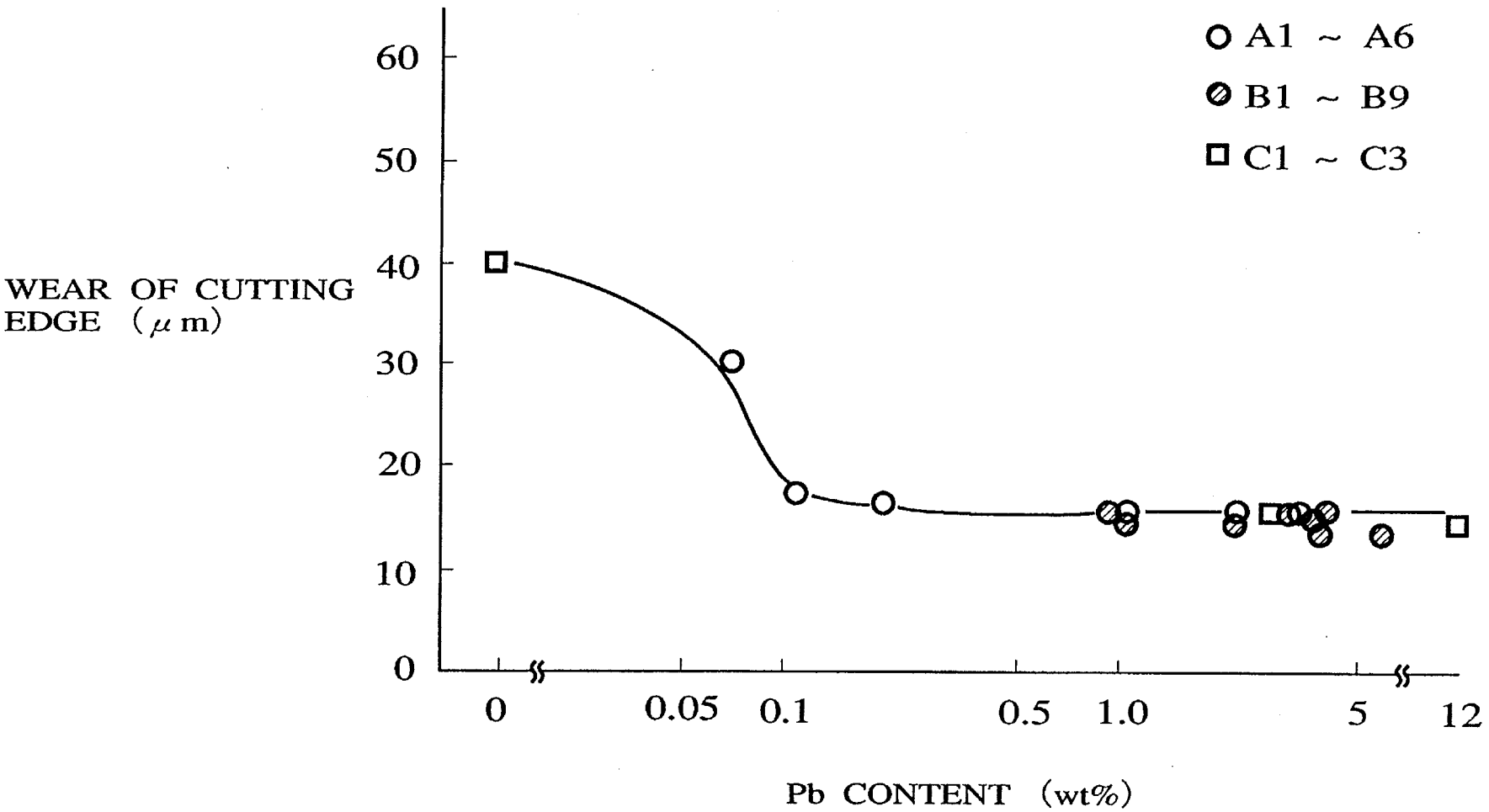
FIG. 3 is a graph showing the relationship between the machinability and the lead content of the valve seat.

FIG. 3 shows the relationship between the lead content of the sintered alloy product and the wear of the cutting edge by processing of valve seats. Improvement of the machinability of the sintered alloy can be found from the reduction of the wear in FIG. 8. In the following drawings, FIGS. 3 to 5, the results of Samples No. A1 to A6 are denoted by circles (○), Samples No. B1 to B9 by slashed circles (●), and Samples No. C1 to C3 by squares (□).

As clearly shown in FIG. 3, the wear of the cutting edge is reduced, as the lead content is raised. The wear is then maintained at a constant level at the lead content of 0.1% by weight or more, irrespective of the maximum particle size of the lead component in the alloy matrix and the DR value (percentage of the lead component dispersed in the alloy matrix). That is, improvement of the machinability results from addition of the lead component only. In view of the machinability imparted to the sintered alloy, at least 0.07% by weight of lead content is necessary, and 0.1% by weight or more of lead content is sufficient to impart satisfactory machinability to the sintered alloy.

Figure 4:
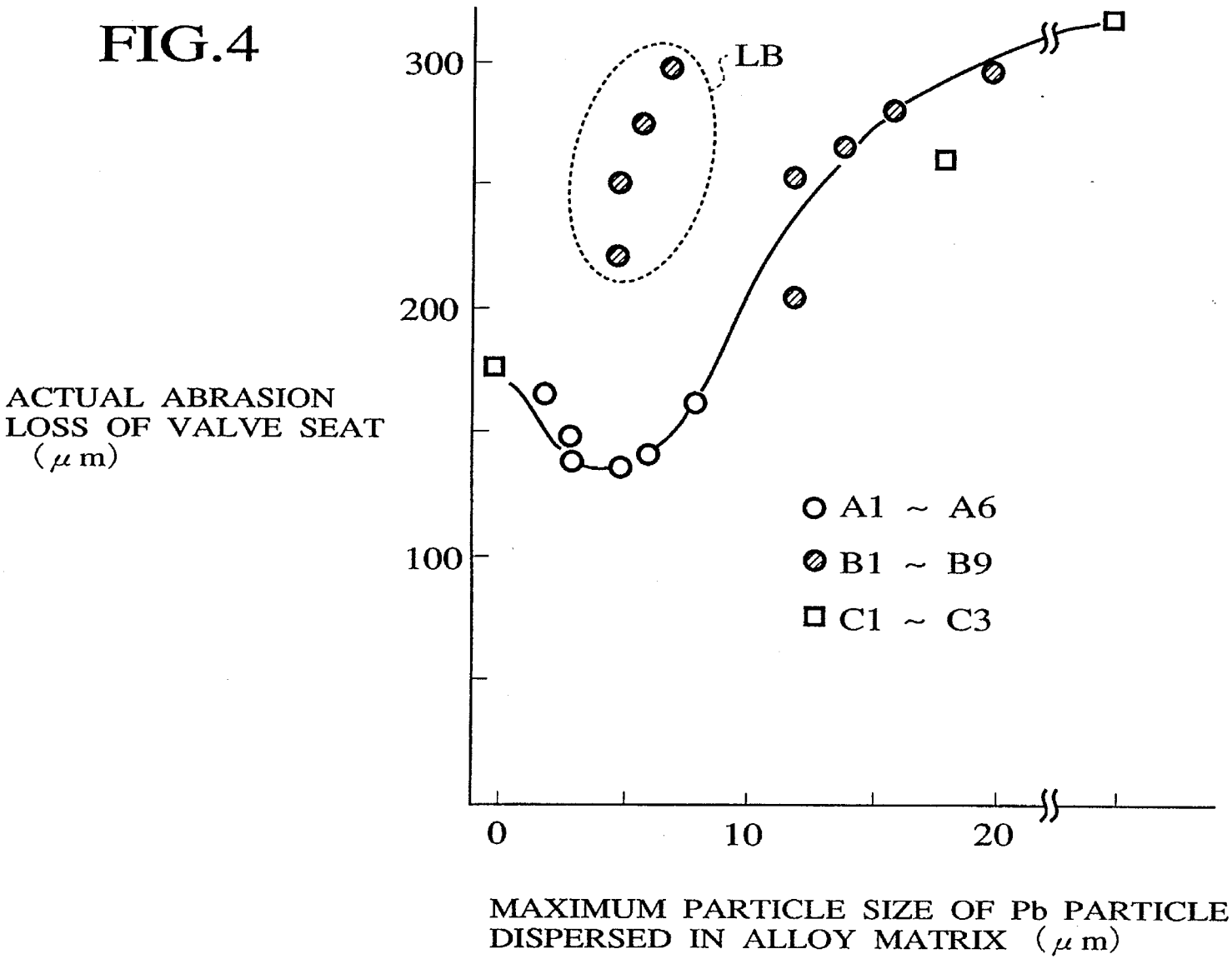
FIG. 4 is a graph showing the relationship between the lead content of the valve seat and the actual abrasion loss in an engine bench test.

FIG. 4 shows the relationship between the maximum particle size of the lead particles dispersed in the alloy matrix and actual abrasion loss of the sintered alloy when the sintered alloy is used as a valve seat at a high temperature in a corrosive environment during a bench test using an actual internal combustion engine. The zone LB inclues the sintered alloy products of Samples No. B1 to B4, in which the DR value is less than 60% by weight.

The sintered alloy of Sample No. C1 which contains no lead component shows excellent abrasion resistance, and the abrasion resistance of each of the sintered alloys of Samples No. C2 and C3 which contain the lead component deteriorates. However, the sintered alloys of Samples No. A1 to A6 in which the maximum particle size of the lead component in the alloy matrix is 10 μm or less exhibit quite prominent abrasion resistance. Therefore, control of the maximum particle size of the lead in the alloy matrix to a range of 10 μm or less is required for improvement of abrasion resistance. The range of 3 μm to 6 μm is the best condition of the maximum particle size of the lead component for improvement of abrasion resistance.

However, the cases of Samples No. B1 to B4 inside the zone LB show that, even when the maximum lead particle size is less than 10 μm, if the DR value is less than 60% by weight, the abrasion loss is large. The reason seems to be because the lead particles are likely to grow due to decrease of the DR value, as described above. Therefore, controle of the DR value to a range of 60% or more is also required for improvement of abrasion resistance.

Figure 5:
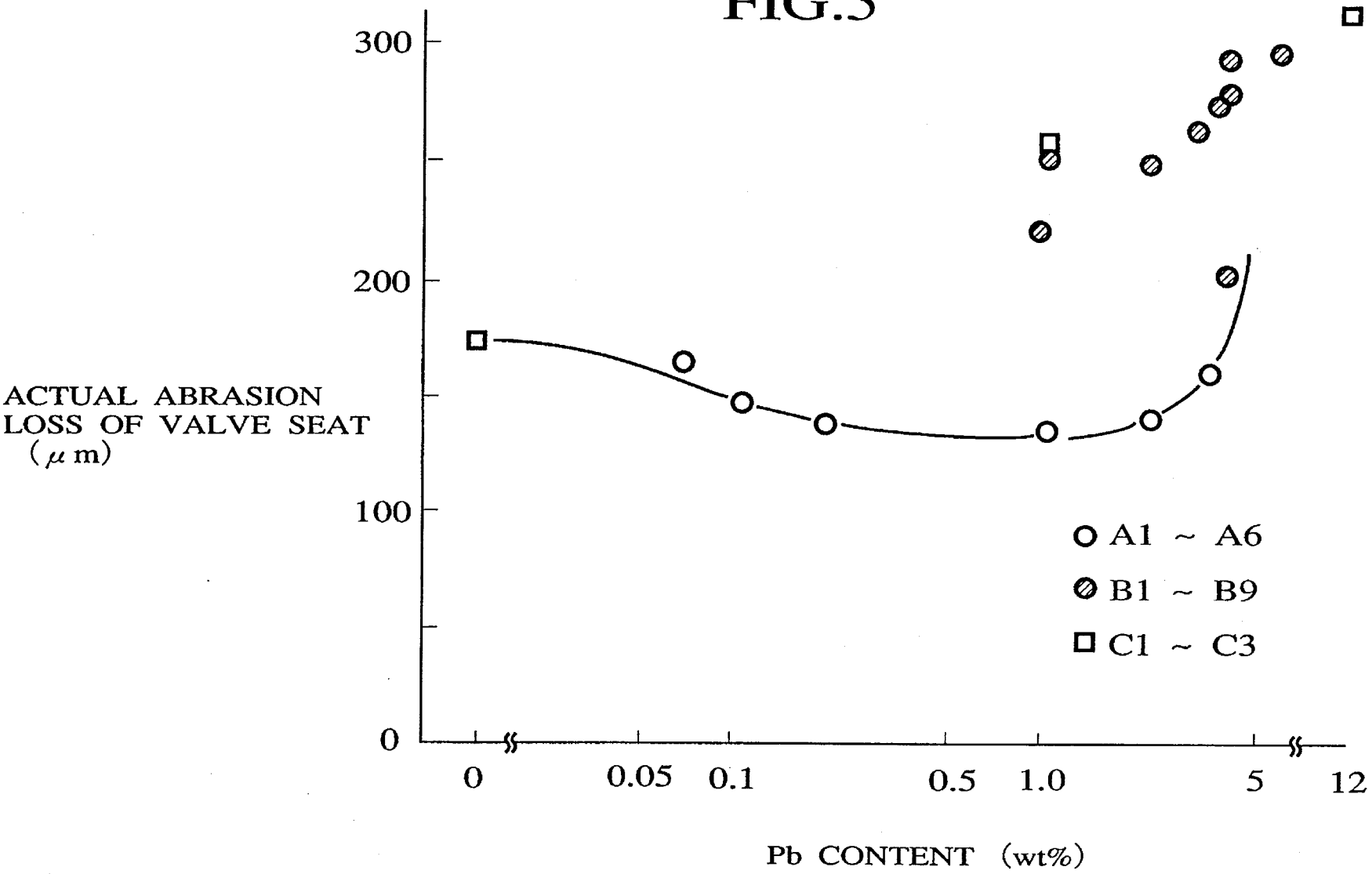
FIG. 5 is a graph showing the relationship between the abrasion loss in the engine bench test and the maximum particle size of the lead particles dispersed in the sintered alloy material.

FIG. 5 shows the relationship between the lead content and actual abrasion loss of the sintered alloy when the sintered alloy is used as a valve seat during a bench test using an actual internal combustion engine.

In FIG. 5, the results of the sintered alloy product which can satisfy the requirement that the maximum particle size of the lead component dispersed in the alloy matrix be 10 μm or less, and that the value DR be 60% by weight or more, lies on a curved line as shown in the graph. As shown in FIG. 5, if the sintered alloy product satisfies both of the above requirements, the abrasion loss is low. However, the curved line shows that, even when the sintered alloy material satisfies the above two requirements, if the lead content exceeds 3.5% by weight, the actual abrasion loss may be increased, namely, the abrasion resistance may deteriorate. This means that increase of the lead content tends to increase the size of the lead particles in the sintered alloy material. Therefore, for a sintered alloy product manufactured by using ordinary metallurgical techniques, regulating the lead content to the range of 3.5% by weight or less is preferred for easy control of the particle size of the lead component.

As a result of the above, it is possible to obtain a sintered alloy which has sufficient strength, abrasion resistance, and machinability, by controlling the maximum particle size of the lead in the alloy matrix to a range of 10 μm or less and controlling the DR value to a range of 60% or more. Moreover, in order to easily satisfy the above requirements, it is preferred to regulate the lead content to 0.1 to 3.5% by weight.

As there are many apparently widely different embodiments of the present invention that may be made without departing from the spirit and scope thereof, it is to be understood that the invention is not limited to the specific embodiments thereof, except as defined in the appended claims.

What is claimed is:

1. A sintered alloy comprising:

an alloy matrix comprising a first alloy phase being composed of approximately 0.5 to 3% nickel by weight, approximately 0.5 to 3% molybdenum by weight, approximately 5.5 to 7.5% cobalt by weight, approximately 0.6 to 1.2% carbon by weight, and the balance iron, and a second alloy phase being composed of approximately 26 to 30% molybdenum by weight, approximately 7 to 9% chromium by weight, approximately 1.5 to 2.5% silicon by weight, and the balance cobalt; and a lead phase contained in the sintered alloy at a content of approximately 3.5% by weight or less, one portion of the lead phase being dispersed in the alloy matrix and the other portion being dispersed in a pore which is formed in the alloy matrix, in which the ratio of said one portion of the lead phase relative to the total of said one portion and the other portion is approximately 60% by weight or more, and said one portion of the lead phase is dispersed in the form of particles in which the maximum particle size is approximately 10 μm or less.

2. The sintered alloy as set forth in claim 1, wherein the content of the second alloy phase in the sintered alloy is within a range of approximately 5 to 25% by weight.

3. The sintered alloy as set forth in claim 1, wherein the content of the second alloy phase in the sintered alloy is approximately 15% by weight.

4. The sintered alloy as set forth in claim 1, wherein the content of the lead phase in the sintered alloy is not less than approximately 0.1% by weight.

5. The sintered alloy as set forth in claim 1, wherein the content of each of the nickel, the molybdenum, the cobalt and the carbon in the first alloy phase is 1.5%, 1.5%, 6.5% and 0.8% by weight, respectively.

6. The sintered alloy as set forth in claim 1, wherein the content of each of the molybdenum, the chromium and the silicon in the second alloy phase is 28%, 8% and 2% by weight, respectively.

7. The sintered alloy as set forth in claim 1, being composed of:

approximately 0.4 to 2.8% nickel by weight;

approximately 1.6 to 10.3% molybdenum by weight;

approximately 7 to 23% cobalt by weight;

approximately 0.5 to 1.1% carbon by weight;

approximately 0.4 to 2.2% chromium by weight;

approximately 0.1 to 0.6% silicon by weight;

approximately 0.1 to 3.5% lead by weight; and the balance iron.

8. A sintered alloy comprising:

a first alloy phase being composed of approximately 0.5 to 3% nickel by weight, approximately 0.5 to 3% molybdenum by weight, approximately 5.5 to 7.5% cobalt by weight, approximately 0.8 to 1.2% carbon by weight, and the balance iron;

a second alloy phase being dispersed in the first alloy phase and being composed of approximately 26 to 30% molybdenum by weight, approximately 7 to 9% chromium by weight, approximately 1.5 to 2.5% silicon by weight, and the balance cobalt; and an effective amount of a lead phase for imparting lubricability to the sintered alloy, the lead phase being dispersed in the sintered alloy in the form of fine particles such that 97% by weight or more of the particles have a particle size of 10 μm or less.

9. A sintered alloy manufactured by the manufacturing method comprising:

a preparing step for preparing a lead powder having a particle size of approximately 50 μm or less;

a mixing step for mixing the lead powder prepared at the preparing step with a first raw material powder containing approximately 0.5 to 3% nickel by weight, approximately 0.3 to 3% molybdenum by weight, approximately 5.5 to 7.5 % cobalt by weight, approximately 0.6 to 1.2% carbon by weight and the balance iron, and a second raw material powder containing approximately 26 to 30% molybdenum by weight, approximately 7 to 9% chromium by weight, approximately 1.5 to 2.5% silicon by weight and the balance cobalt, to form a mixed powder so that the lead content in the mixed powder is not more than approximately 3.5% by weight;

a compacting step for compressing the mixed powder into a compact;

a sintering step for heating the compact to a temperature of approximately 1,160° to 1,220° C. to sinter the compact; and a cooling step for cooling the compact, after the sintering step, so that the temperature of the compact in the vicinity of 328° C. is cooled at a cooling rate of approximately 2° C./min. or more.

10. The sintered alloy as set forth in claim 9, for use as a slide member which is applied to heat in a corrosive environment.

11. The sintered alloy as set forth in claim 9, for use as a valve seat or a valve for a valve operating system of an internal combustion engine for use with leaded gasoline.

* * * * *

UNITED STATES PATENT AND TRADEMARK OFFICE

CERTIFICATE OF CORRECTION

PATENT NO. : 5,529,602

DATED : June 25, 1996

INVENTOR(S) : K. ISHII et al.

It is certified that error appears in the above-indentified patent and that said Letters Patent is hereby corrected as shown below:

At column 17, line 19 (claim 8, line 5), change "0.8" to ---0.6---.

Signed and Sealed this

Twenty-fifth Day of March, 1997

*Attest:*

*Attesting Officer*

Bruce Lehman

BRUCE LEHMAN

*Commissioner of Patents and Trademarks*